United States Patent [19]

Rasmussen et al.

[11] Patent Number: 4,595,379

[45] Date of Patent: Jun. 17, 1986

[54] BOTTLE DRIVEN ARTICULATED DOLL

[75] Inventors: Russell G. Rasmussen, Skokie, Ill.; Steven P. Hanson, Richfield, Minn.; Jeffrey D. Breslow, Highland Park, Ill.

[73] Assignee: Marvin Glass & Associates, Chicago, Ill.

[21] Appl. No.: 691,130

[22] Filed: Jan. 14, 1985

[51] Int. Cl.[4] ..... A63H 3/40

[52] U.S. Cl. ..... 446/341; 446/359; 446/304

[58] Field of Search ..... 446/304, 330, 352, 353, 446/354, 305, 339, 359, 337, 365, 343, 341

[56] References Cited

U.S. PATENT DOCUMENTS

| | | | |
|---|---|---|---|
| 3,147,566 | 9/1964 | Ong | 446/359 |
| 3,229,421 | 1/1966 | Ostrander | 446/304 |
| 3,514,899 | 6/1970 | Bonanno et al. | 446/354 |
| 4,033,071 | 7/1977 | Strongin et al. | 446/304 X |
| 4,074,460 | 2/1978 | Thorn et al. | 446/304 |

FOREIGN PATENT DOCUMENTS

| | | | |
|---|---|---|---|
| 2040706 | 9/1980 | United Kingdom | 446/304 |

*Primary Examiner*—Mickey Yu

*Attorney, Agent, or Firm*—John S. Pacocha

[57] ABSTRACT

A toy doll with arms and legs mounted for pivotal movement relative to the torso in response to rotational movement of a bottle nipple in the doll's mouth. One gear on a rotatable feed tube within the hollow head of the doll engages vertically oriented racks that then engage spur gears to rotate the arms. A bevel gear also carried by the tube engages a bevel gear on a depending drive shaft that has a crown gear driving a bevel gear for each of the legs. Both the arms and the legs are mounted on spools that freely rotate with respect to the torso. Frictional engagement of the limbs with respect to the spool permit the spool to pivotally drive the arms while also allowing selective, independent angular orientation of each of the limbs with respect to its respective spool.

16 Claims, 5 Drawing Figures

BOTTLE DRIVEN ARTICULATED DOLL

BACKGROUND OF THE INVENTION

1. Field of the Invention

This invention relates generally to mechanically articulated dolls and more particularly to a baby doll whose arms and legs are driven by rotational movement of a simulated feeding bottle.

2. Background Art

Mechanical dolls with articulated arms and legs such as the one disclosed in U.S. Pat. No. 3,147,566 are old in the art. Similarly, simulated feeding bottles have been used in actuate features in mechanical dolls and more particularly the eyes and cheeks such as disclosed in U.S. Pat. Nos. 4,033,071 and 4,074,460. There remains a need however, for mechanical dolls with articulated arms and legs that can be pivoted by rotation of a simulated feeding bottle inserted in a mouth opening. Additionally there remains a need for dolls with selectively drivable arms, legs, and eyes using a simulated feeding bottle.

SUMMARY OF THE INVENTION

The present invention is concerned with providing a mechanical doll with articulated arms and legs that are simultaneously drivable by rotation of a simulated feeding bottle inserted in the mouth of the doll as well as providing selective pivotal movement of arms, legs and side-to-side movement of eyes through rotational movement of a simulated feeding bottle. These and other objects and advantages of the invention are achieved by providing a doll with a hollow head and torso and mounting a rotational drive tube behind a mouth opening in the head of the doll. The tube drivingly receives a gear on the nipple of the simulated feeding bottle through the open mouth. Arms and legs are attached to the torso for driven pivotal movement relative to the torso by frictional engagement while permitting angular reorientation of the limbs relative to the torso. Gears supported within the hollow head and torso transmit rotational driving movement of the bottle to the limbs. In an alternative embodiment the drive tube is also shiftable transverse to its axis to selectively engage either arm, the legs, or side-to-side movable eyes.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
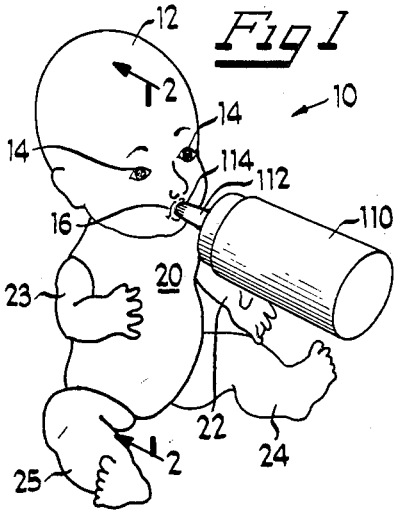
FIG. 1 is a perspective view of an embodiment of the present invention.

Referring now to the drawing in which like parts are designated by like reference numerals throughout the several views, there is shown in FIG. 1 a doll 10 having a head 12 with eyes 14 and a mouth 16. Head 12 is integrally formed with a torso 20 or may alternatively be separately formed and connected to the torso to provide for movement of the head relative to the torso.

Mounted for rotation relative to the torso are left and right arms 22 and 23, respectively. Also mounted for rotation relative to the torso at a hip joint are left and right legs 24 and 25, respectively. The doll may be formed of a hard plastic such as polystyrene or a relatively more pliable material that is still self-supporting such as vinyl.

Open mouth 16 leads to an internal cone feed gear 30 which is formed as part of the drive tube 32 contained within the head 12. Flange 34 immediately behind the mouth retains the shaft adjacent the front of the head and a stepped down end portion 36 is journaled for rotation in a plate 38 extending across a rear portion of the hollow head 12. Either formed integrally with the drive tube or attached for rotation with the drive tube are a spaced apart spur gear 40 and bevel gear 42.

Figure 3:
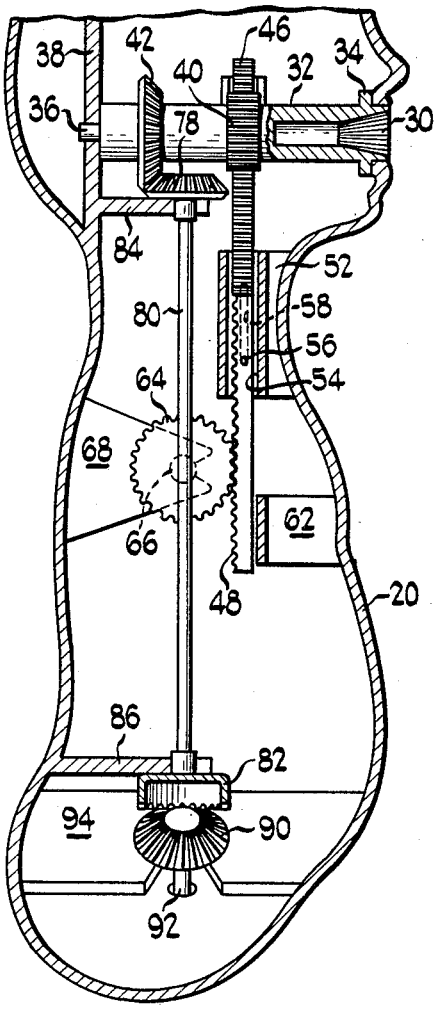
FIG. 3 is a fragmentary, sectional view taken generally along the line 3—3 of FIG. 2.

On either side, and in engagement with, spur gear 40 are left and right arm racks 44 and 45 respectively. Each of the arm racks has an upper rack portion 46 and 47, respectively, as well as a lower rack portion 48 and 49, respectively. The teeth on each of the upper and lower portions of the rack are at ninety degrees to each other as is best illustrated in FIG. 3. Arm racks 44 and 45 are carried for limited reciprocal movement within the torso 20 by chest channels 52 and 53, respectively, that extend inwardly from the upper chest area of the torso and may be formed as an integral part of the torso.

Channels 52 and 53 each have an enclosed, elongated boxlike channel 54 with a transverse guide pin 56 that is slidingly received within a slot 58 in the respective rack. Additional support for each rack is provided by an upper left beam 60 and right beam 61 extending in toward the drive tube 32 within the head 12 and a lower left standard 62 (the right standard is not shown). As with the chest channels, the beams and standards may be integrally formed as part of the doll. While both the left and right upper racks are in engagement with the spur gear 40, the lower left rack 48 and the lower right rack 49 are in engagement with left and right arm gears 64 and 65, respectively.

Each of the arm gears is mounted on shoulder shafts 66 and 67 respectively. The shoulder shafts are supported for rotation adjacent one end by a back brace 68 and 69, respectively. At the other end of each shoulder shaft is a shoulder spool 70 which rotates together with the respective arm gear and shoulder shaft. Shoulder spool 70 has an outer annular flange 72 and an inner annular flange 74. One of each of the arms 22 and 23 is secured to a spool 70 for rotation with the spool while the spool is permitted to freely rotate within the torso so that reciprocating movement of the arm racks results in a driving pivoting movement of each of the arms. Although the arm fits tightly enough about the spool to provide driving frictional engagement, the arm does slip to provide for manual angular reorientation of the arm relative to the spool and torso.

Bevel gear 42 on the drive tube 32 engages a transverse bevel gear 78 secured for rotation on the top of an elongated drive shaft 80. Attached for rotation with shaft 80 at the lower end of the shaft is a crown gear 82. Drive shaft 80 is supported below the bevel gear 78 by upper support 84 and lower support 86 each of which may be integrally formed with the torso of the doll. Crown gear 82 engages left and right leg bevel gears 90 and 91, respectively, and each of the gears is secured for rotation on a respective hip shaft 92 and 93. Each of the shafts 92 and 93 is supported for rotation in a respective hip bracket 94 and 95 adjacent the respective bevel gear.

At the other end of each of the hip shafts is a hip spool 98 that is rotatably retained in openings in the torso 20 by means of an annular flange 102. Each of the hip spools has an outer annular flange 104 which is in relatively tight frictional engagement with one of the legs 24 and 25. The hip spool is secured for rotation on the hip shaft and because of the relatively tight frictional engagement with the leg transmits rotational or pivotal movement through the hip bevel gear and hip shaft to rotate the legs in response to rotation of the drive tube 32. While there is sufficient frictional engagement to enable driving rotation of the legs, the frictional engagement between each leg and hip spool permits the angular relationship between the legs and the respective spools to be changed.

The relationship of the arm drive by spur gear 40 to arm gears 64 and 65 through the racks may conveniently be one to one while the relationship of the leg drive may be more or less by selection of an appropriate ratio of the crown gear 82 to the leg bevel gears 90 and 91. Thus a differentiation of movement between the arms and the legs may be obtained from the same rotation of drive tube 32. For example, the arms may be driven rather furiously with the kicking movement of the legs being barely perceptible.

Toy doll 10 is provided with a simulated feeding bottle 110, the nipple 112 of which has a conical gear 114 that engages the internal cone feed gear 30 in the drive tube 32. Thus, in play, a child may simulate feeding of the baby doll 10 while rotating the bottle 110 back and forth to cause the arms and legs of the doll to move back and forth simulating the arm waving and leg kicking of a contented baby.

Figure 5:
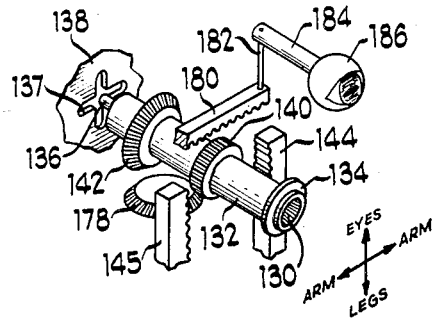
FIG. 5 is a fragmentary, perspective view of an alternative embodiment.
Figure 4:
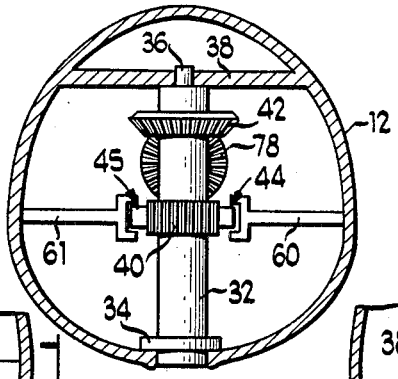
FIG. 4 is a sectional view taken generally along the line 4—4 of FIG. 2.
Figure 2:
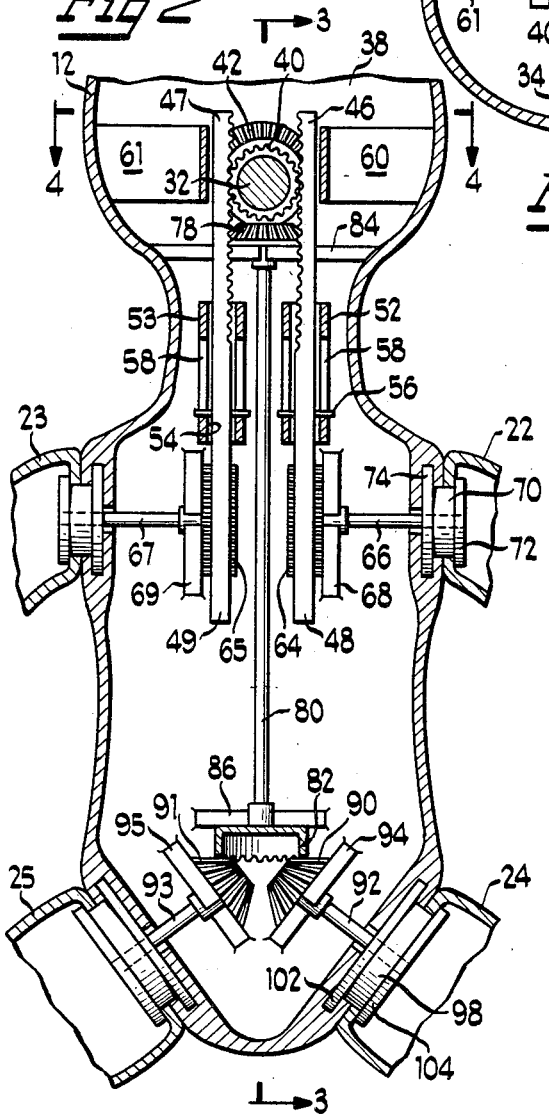
FIG. 2 is an enlarged scale, fragmentary, sectional view taken generally along the line 2—2 of FIG. 1.

In the alternative embodiment illustrated in FIG. 5, the doll is provided with an internal cone feed gear 130 in a drive tube 132 similar to that previously described. However, the stepped down end portion 136 is received in a cross slot 137 in a plate 138 extending across the inside the head of the doll. An inside flange 134 fits around the inside of the dolls mouth. Rather than being in constant engagement with arm racks 144 and 145 and leg bevel gear 178, the spur gear 140 and the bevel gear 142 in this embodiment are spaced out of engagement with the respective arm racks 144 and 145 and the leg bevel drive gear 178.

A horizontal eye rack 180 is spaced above and normally out of engagement with the spur gear 140. Rack 180 may be mounted for substantially horizontal reciprocating movement in a manner similar to the mounting of the arm racks for limited vertical reciprocal movement. Adjacent each end of the horizontal rack there is an upwardly extending pin 182 atop which extends a bar 184 with an eye 186 secured to the end of the bar 184 remote from the pin 182. The eye is mounted for side to side pivotal movement within the head of the doll is a conventional manner. Side-to-side reciprocation of the rack 180 drives the eyes from side-to-side.

This embodiment allows the child to selectively engage the eyes, the legs, or either arm by exerting a force up, down, or to one side on the bottle 110. Exerting the force in any one of the selected positions transverse to the axis of tube 132 shifts the stepped down end portion 136 within the cross slot 137 and brings the spur gear 140 into engagement with either of the racks 144, 145 or 180 or brings the bevel gear 142 into driving engagement with the bevel gear 178 as is diagrammatically illustrated in FIG. 5.

While particular embodiments of the present invention have been shown and described, further changes and modifications will occur to those skilled in the art. It is intended in the appended claims to cover all such changes and modifications as fall within the true spirit and scope of the present invention.

What is claimed as new and desired to be secured by Letters Patent is:

1. An articulated doll comprising:

a hollow head and torso;

the head including an open mouth;

arms and legs mounted for rotational movement relative to the torso;

an external drive member having a gear fitting into the mouth of the doll;

drive means for effecting the back and forth pivoting movement of the arms and legs relative to the torso;

gear means carried within the hollow head and torso for transmitting rotational movement of the drive member to the arm and leg drive means to pivot the arms and legs back and forth relative to the head and torso;

the gear means including a drive tube carried within the hollow head for rotational movement both clockwise and counterclockwise about the axis of the tube;

the tube having a first coaxial gear engageable through the mouth by the external drive member;

additional coaxial gear means attached for rotation with the tube being engageable with the arm and leg drive means;

the arm and leg drive means includes separate drive means for the left arm and separate drive means for the right arm;

the drive tube is mounted for limited movement transverse to the axis of the drive tube as well as for rotational movement about the axis; and the additional coaxial gear means is, by movement of the drive tube transverse to the axis, selectively engagable with either the left arm drive means or right arm drive means.

2. The doll of claim 1 in which the additional coaxial gear means is, by movement of the drive tube transverse to the axis, selectively engageable with the drive means for the legs.

3. The articulated doll comprising:

a hollow head and torso;

the head including an open mouth;

left and right arms and left and right legs mounted for rotational movement relative to the torso;

an external drive member having a gear fitting into the mouth of the doll;

gear means carried with the hollow head and torso for transmitting rotational movement of the drive member to the arms and legs to pivot the arms and legs relative to the head and torso;

the gear means including a drive tube carried within the hollow head for rotational movement both clockwise and counterclockwise about the axis of the tube;

the gear means including means for driving the left arm and the right arm for rotational movement relative to the torso;

the gear means including means for driving the left leg and the right leg for rotational movement relative to the torso;

the drive tube having a first coaxial gear engagable by the external drive member;

the drive tube having a second coaxial gear engagable with the arm drive means; and the drive tube having a third coaxial gear engagable with the leg drive means.

4. The doll of claim 3 including:

eyes mounted within the head;

means within the head mounting the eyes for side-to-side movement;

means included in the gear means for driving the eyes to side-to-side movement; and the second coaxial gear on the drive tube also being engagable with the eye drive means.

5. The doll of claim 3 in which:

the drive tube is mounted for limited vertical and lateral movement as well as rotational movement; and the second coaxial gear selectively engages either drive means for the left arm or drive means for the right arm.

6. The doll of claim 5 in which the third coaxial gear is selectively engageable with drive means for the legs.

7. The doll of claim 3 in which:

the arm drive means includes a rack carried within the hollow head and torso for limited reciprocal movement; and the rack member has a first gear rack along one edge and a second gear rack along a substantially transverse edge.

8. The doll of claim 7 including a spur gear mounted for rotational movement with each arm and engaging one of the gear racks.

9. The doll of claim 3 in which the gear means pivots the legs at a different ratio than the arms.

10. The doll of claim 3 including:

a mounting spool for each of the arms and legs;

each mounting spool being in driving engagement with the gear means; and the arms and legs frictionally engaging a respective spool permitting each arm and leg to be independently angularly oriented with respect to the mounting spool.

11. An articulated doll comprising:

a hollow head and torso;

the head including an open mouth;

elongated arms and legs, each mounted for rotational movement about its respective generally longitudinal axis relative to the torso;

a gear secured to each of the arms and legs for rotation with the respective arm or leg about the respective longitudinal axis;

an external, manually back and forth rotatable, drive member having a gear fitting into the mouth of the doll for driving each arm and leg back and forth about its respective generally longitudinal axis;

transmitting means carried within the hollow head and torso for transmitting rotational movement of the drive member to the arms and legs to drive each arm and leg back and forth about its respective longitudinal axis relative to the head and torso;

the transmitting means including a drive tube carried within the hollow head for rotational movement both clockwise and counterclockwise about the axis of the tube;

the tube having a first coaxial gear engagable through the mouth by the external drive member;

the transmitting means also including intermediate gear means between the tube and the gears secured to each of the arms and legs; and additional coaxial gear means attached for rotation with the tube being engageable with the intermediate gear means.

12. The doll of claim 11 in which the additional coaxial gear means includes a second coaxial gear and a third coaxial gear.

13. The doll of claim 1 including:

eyes mounted within the head for side-to-side movement;

drive means for effecting the side-to-side movement; and the additional coaxial gear means also being engagable with the eye drive means.

14. The doll of claim 11 including:

a mounting spool for each of the arms and legs;

each mounting spool being in driving engagement with the gear secured to its respective arm or leg; and the arms and legs frictionally engaging a respective spool permitting each arm and leg to be independently angularly oriented with respect to the mounting spool.

15. The doll of claim 1 in which the transmitting means drives the legs at a different ratio than the arms.

16. The doll of claim 11 in which the intermediate gear means includes a single elongated shaft, substantially transverse to the drive tube, carried for rotation within the torso for transmitting clockwise and counterclockwise rotation of the drive tube to the gear secured to each of the legs.

* * * * *